US005470538A

United States Patent [19]

Lind

[11] Patent Number: 5,470,538

[45] Date of Patent: Nov. 28, 1995

[54] PIPETTE TIP RACK LOADER

[75] Inventor: Peter M. Lind, Yountville, Calif.

[73] Assignee: LABCON, North America, San Rafael, Calif.

[21] Appl. No.: 253,977

[22] Filed: Jun. 3, 1994

[51] Int. Cl.[6] ..... B01L 3/02; B65D 85/00

[52] U.S. Cl. ..... 422/104; 422/100; 206/443; 53/245

[58] Field of Search ..... 422/100, 99, 103, 422/104; 206/486, 499, 503, 562, 443; 53/245, 260

[56] References Cited

U.S. PATENT DOCUMENTS

| | | | |
|---|---|---|---|
| 3,853,217 | 12/1974 | Scordato et al. | 206/223 |
| 4,130,978 | 12/1978 | Cohen | 53/444 |
| 4,349,109 | 9/1982 | Scordato et al. | 206/562 |
| 4,577,760 | 3/1986 | Rainin et al. | 206/508 |
| 4,963,493 | 10/1990 | Daftsios | 435/287 |
| 5,128,105 | 7/1992 | Berthold et al. | 422/104 |
| 5,232,669 | 8/1993 | Pardinas | 422/100 |
| 5,318,753 | 7/1994 | Honda | 422/104 |
| 5,324,482 | 6/1994 | Scaramella et al. | 422/100 |
| 5,392,914 | 2/1995 | Lemieux et al. | 206/499 |

OTHER PUBLICATIONS

Continental Laboratory Products Ad for Reloadable Pipette Tip Trays, 1994.

Rainin Instruments Ad for Green–Pak SpaceSaver Tip–Rack Refill System, 1994.

*Primary Examiner*—James C. Housel

*Assistant Examiner*—Long V. Le

*Attorney, Agent, or Firm*—Phillips, Moore, Lempio & Finley

[57] ABSTRACT

A pipette tip rack loader is disclosed that will load a flat of pipette tips into a rack for use on a laboratory bench. The flat for the pipette tips is substantially the same dimensions as the top surface of the tip rack to be loaded, and has an identical hole pattern so that the ends of the tips loaded in the flat can be positioned one-to-one in the holes of the tip rack. The loader consists of an upper platform that holds the flat and a lower platform or base that holds the unloaded tip rack. The upper platform is biased in a first position sufficiently high enough above the tip rack that the tips do not hit the rack. The upper platform can be depressed so that the tips in the flat thread into the tip rack holes. As the upper platform nears the tip rack, the flat is released from the upper platform to rest on the tip rack with the tips registered in the rack. Several flats with tips may be positioned in the loader with tips in the upper flats. The loader operates such that only one flat is released at a time.

17 Claims, 6 Drawing Sheets

PIPETTE TIP RACK LOADER

BACKGROUND OF THE INVENTION

The invention relates to a device for loading pipette tips that have been positioned in a flat into an upstanding pipette rack for use in the laboratory.

In recent years, the use of pipettes and pipette tips has become widespread because of the requirements to maintain sterile or aseptic conditions while conducting various laboratory tests. This usage occurs both in the medical testing laboratory, wherein fluid samples taken from human beings are tested in various laboratory procedures, and extends to the biomedical and bioengineering laboratories where research is done in advanced areas of biology and the like.

The requirement to maintain an aseptic condition is paramount in that contamination of any sort in the biological laboratory can result in improper findings relating to the particular area being investigated. In the medical field, it is even more important as the tests performed may very well result in having a lasting impact on the patient upon which the tests were performed. In the last ten or fifteen years, the requirement for tests for HIV or Human Immunodeficiency Virus, has put even more severe pressure on medical testing laboratories. A false positive test, of course, results in severe hardship on the patient, while a false negative test would not only have impact on the patient, but could result in more widespread disease. From the laboratory technician's standpoint, contact with contaminated specimens that are being tested is, of course, of vital concern as the laboratory technician could suffer from the very disease that he or she is attempting to investigate should contamination become widespread.

Accordingly, laboratories have reached the point that laboratory equipment, particularly the interface of the equipment and the sample, is simply not handled by a human being after sterilization.

Pipettes and pipette tips are used, of course, and have been used for a number of years, to obtain small, measured samples of whatever is to be tested. Until about 20 years ago, pipettes were a single entity made of glass, and were cleaned and sterilized after each use. About 20 years ago, the plastic pipette tip and a mechanical pipettor came on the market and rapidly achieved widespread use. The single pipettor used a pipette tip approximately 2 to 2½ inches long that is tapered in its form so that it would fit on a tapered end of the pipettor. The pipettor has a piston action that creates a suction within the pipette tip so that fluids can be drawn up into the pipettor. The advantage of the mechanical pipettor is that the plastic tip can be thrown away as that is the only area that the sample touched. Since great numbers of pipette tips are used, these pipette tips are usually sold in racks. Pipette tips racks appeared in the market concurrently with the pipette tips, but always presented a problem of how to load the pipette tips into the racks. While methods have been devised to load tips into the racks, the concern for the environment has caused a movement in the laboratories to avoid use of pipette tip racks which, in the past, were thrown away once they were empty. Accordingly, it has become the practice of the laboratories to buy racks loaded with pipette tips and as the racks are emptied, pipette tips sold in bulk are reloaded into the racks by hand.

The manual loading of pipette tips is tedious and time-consuming. Thus, in recent months, the manufacturers of pipette tips have attempted to utilize schemes for loading pipette tips into the trays for use in laboratories.

The requirement for a tray is present because the present pipettors are multiple-channel pipettors; that is, they mount either eight or twelve pipette tips at a time so that eight or twelve samples can be taken concurrently. The rack sits on the laboratory bench and the pipettor is forced down onto a row of pipette tips contained in the rack. The rack usually is formed with eight tips across and twelve tips lengthwise. A de facto standard among pipettor manufacturers dictates the spacing between the pipette tips and the rack.

The present reloading devices are cumbersome and appear to save only a small percentage of plastic in their attempt to resolve the reuse of pipette tips racks.

The present invention reduces the use of plastic considerably more than the existing racks so that the user can buy pipette tips loaded in a flat and then, by using a specially-designed device, load those stacked pipette tip flats into conventional racks for use on the laboratory bench.

It is an object of this invention to provide a loading device for pipette tips that will enable the user to load tips into conventional racks that are found in the marketplace.

It is another object of this invention to reduce the use of plastics in the manufacture of pipette tips and pipette tip racks.

It is still another object of this invention to provide a device that will load multiples of pipette tip flats into a series of pipette tip racks.

SUMMARY OF THE INVENTION

This invention is for loading a device for placing a plurality of pipette tips positioned in a flat into an upstanding pipette tip rack.

The loading device consists of a rectangular base assembly and a pair of side plates affixed at opposite ends of the base assembly to extend upwardly therefrom. The device also includes a platform assembly movably associated with the pair of side plates so that the platform may move from a first position distal of the base to a second position proximate of the base. Parallel motion means maintain the platform assembly in a parallel relationship with the base assembly while the platform moves from a first position to a second position. The platform assembly includes release means for retaining a flat on the platform assembly while the platform assembly is distal of said base and for releasing said flat in a predetermined position while said platform moves to its second position proximate the base.

DETAILED DESCRIPTION OF THE PREFERRED EMBODIMENT

Figure 1:
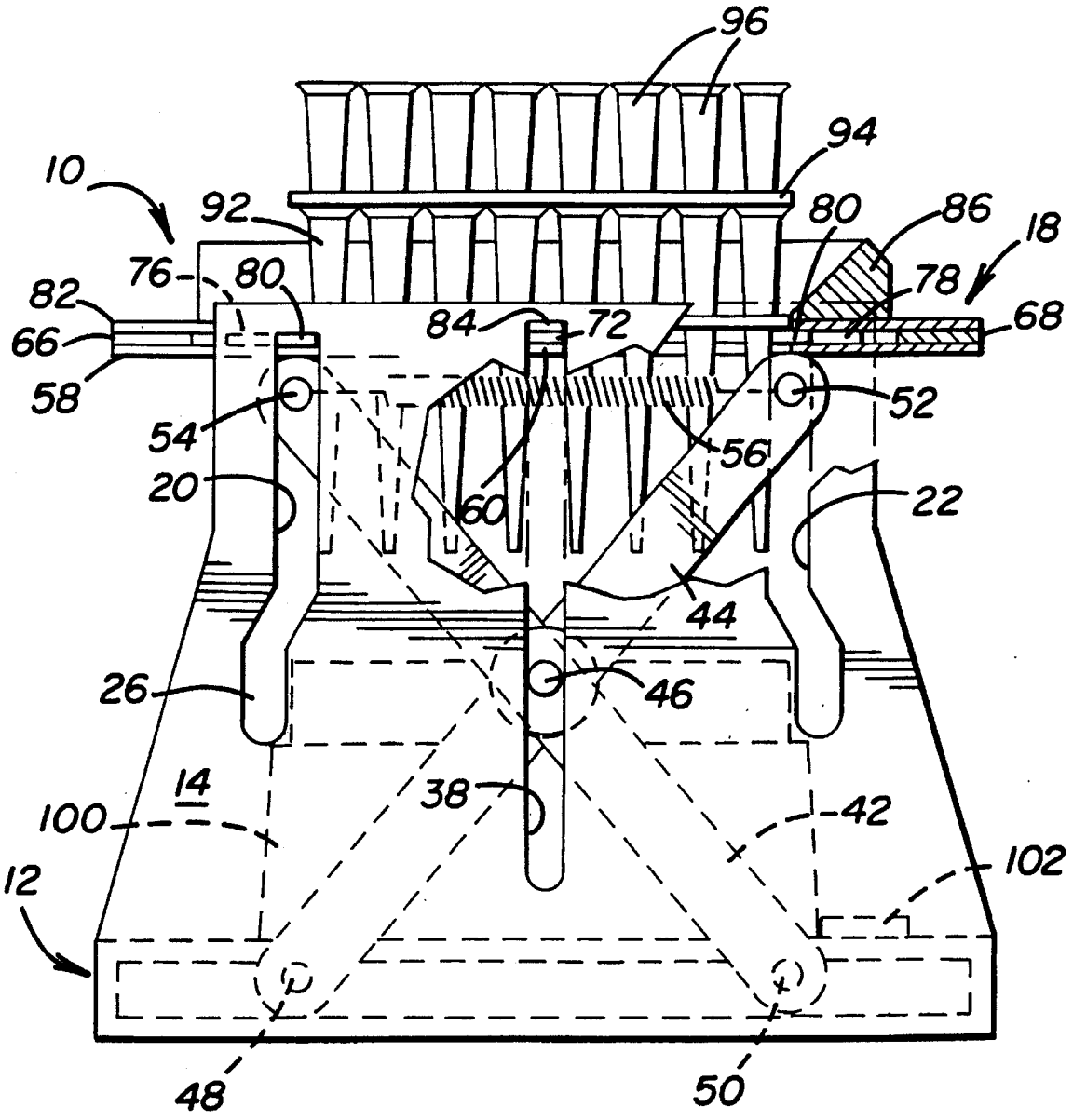
FIG. 1 is an end view of the pipette tip loading device described herein in its first position.
Figure 2:
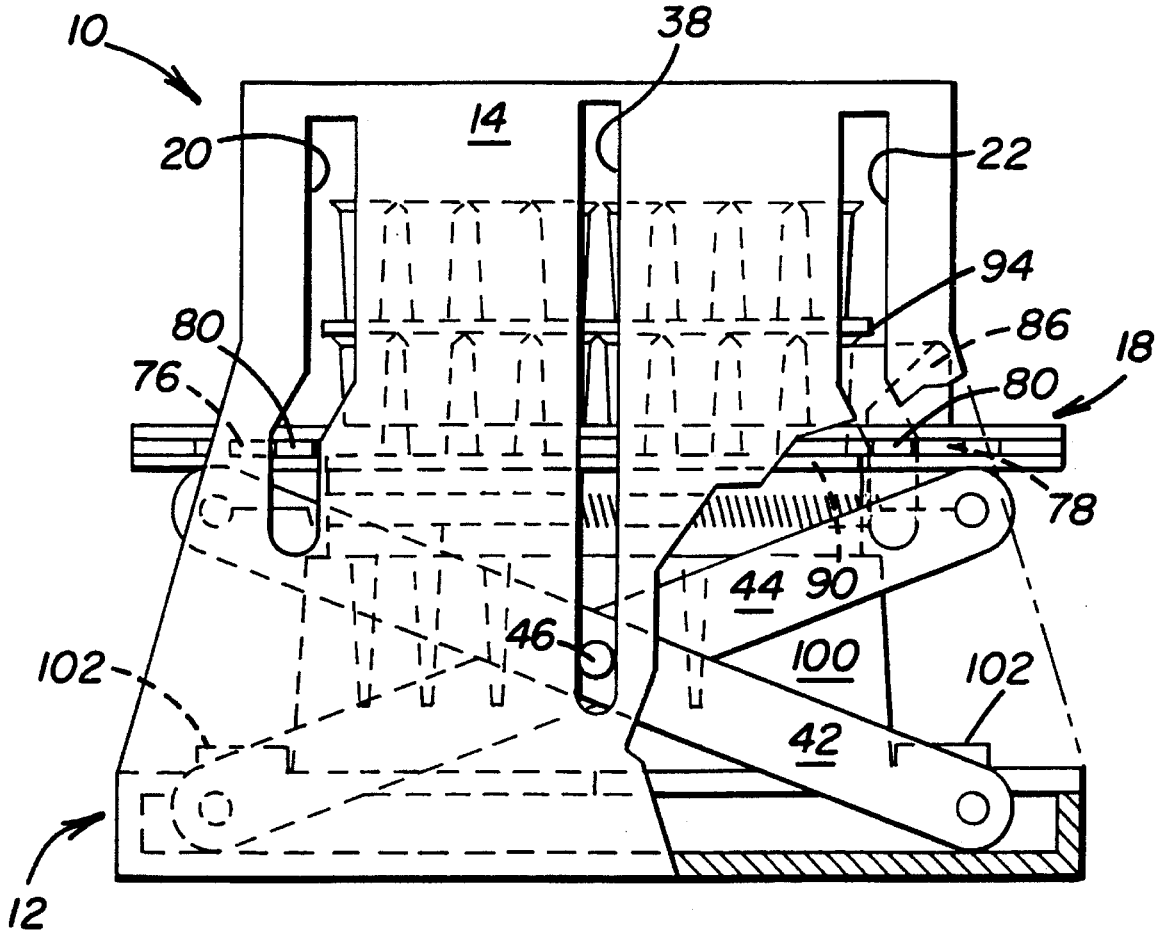
FIG. 2 is an end view of the same pipette tip loading device in its second position.
Figure 3:
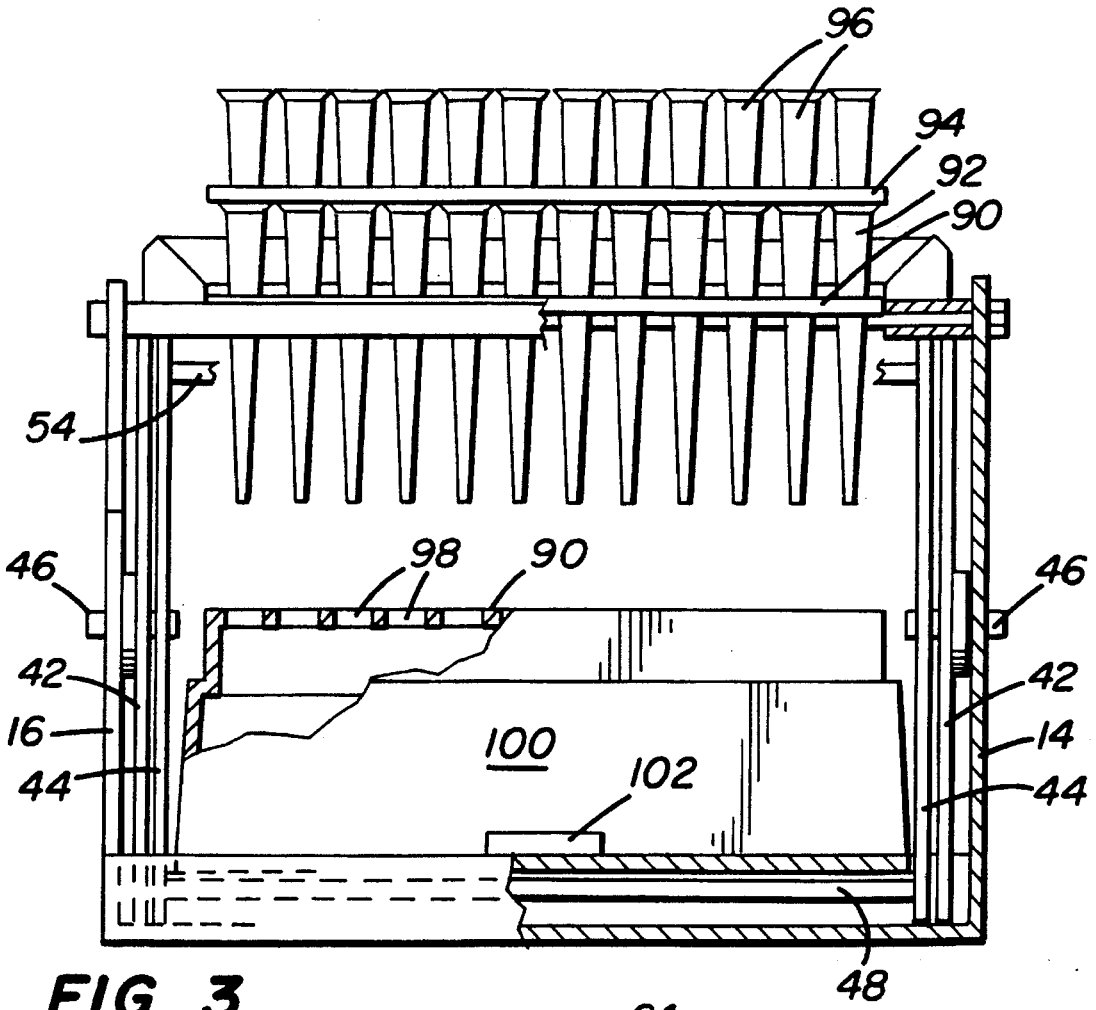
FIG. 3 is a side view of the pipette tip loading device shown in FIG. 1.

Referring now to FIG. 1, a pipette tip rack loading device 10 is shown. The pipette tip loading device 10 includes a rectangular base member 12. A pair of side plates 14 and 16 (see FIG. 3) are upstanding of the base member 12. A platform assembly 18 is movably associated with the side plates so that the platform assembly 18 can move from its first position as shown in FIG. 1 to its second position as shown in FIG. 2 in a parallel relationship to the base member 12. It should be noted that the platform assembly is also rectangular and substantially the same dimensions as the base member 12.

Figure 5:
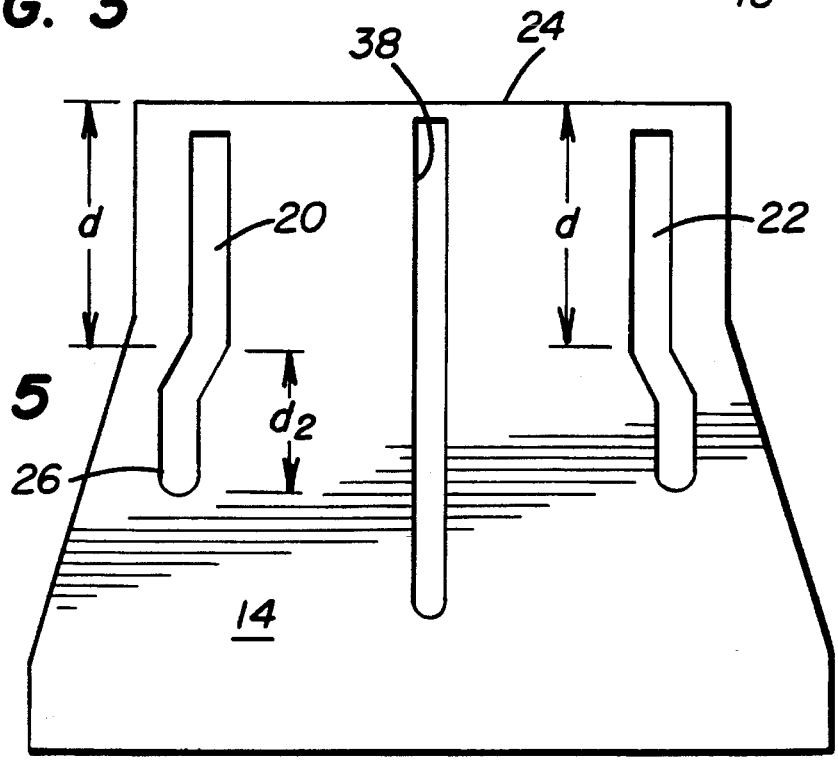
FIG. 5 is an elevation view of one of the side plates.

Referring to FIG. 5, an end view of one of the two side plates is depicted. The side plates have a pair of camming slots 20 and 22 extending downwardly from the upper edge 24 thereof. Each of the cam slots extends downwardly a predetermined distance d. They are separated by a second predetermined distance. As they approach the base member 12, they diverge outwardly for a second distance d2 so that they are separated by a distance greater than they were at the upper end 24 of the side plate 14. At the bottom of the groove, there is a short area 26 wherein the slot extends again vertically downwardly toward the base 10. Interspersed between the two slots 20 and 22 is a third camming slot 38. The purpose of the cam slots 20 and 22, briefly stated, is to operate the release mechanism which will be described in relation to the upper platform. The purpose of cam slot 38 is to act as a guide for the parallel motion means also to be described. It is pointed out that the second side panel 16 is identical to the first side panel 14, with the camming slots in the same position.

Figure 6:
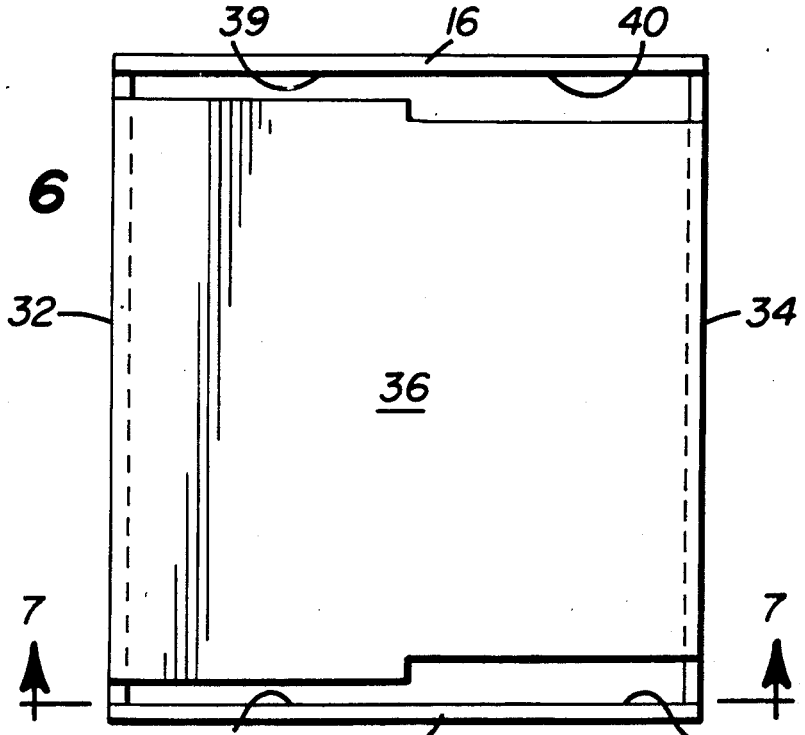
FIG. 6 is a plan view of the base assembly.
Figure 7:
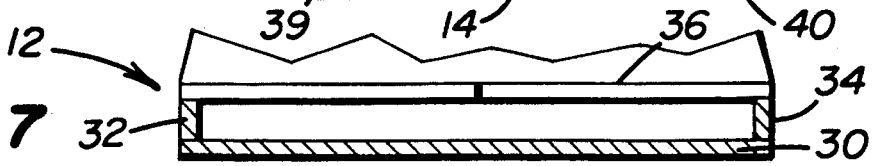
FIG. 7 is an end view of the base assembly.

Referring now to FIGS. 6 and 7, the base member 12 is shown. Base member 12 consists of a lower base 30, shown in FIG. 7, two side members 32 and 34, also shown in FIG. 7, and an upper base platform 36, shown in FIG. 6. Upper base member 36 is not as wide as the lower base member 30 as evidenced in FIG. 6. This smaller dimension creates openings 39 and 40 between the side members 14 and 16. The opening 39 is enlarged on one-half of the base member at 40, as shown in FIG. 6. The purpose of the openings 39 and 40 is to permit the parallel motion members 42 and 44 to extend downwardly into the slots 39 and 40.

Parallel motion members 42 and 44 are best seen in FIG. 1. They are identical in structure and form an X-type or scissors mechanism, as can be seen in FIG. 1. The two members 42 and 44 are pivotably affixed one to the other by an axle 46 so that they may have a scissors-type motion. Axle 46 extends outwardly into slot 38 when the device is assembled (see FIGS. 1 and 2).

At the lower end of the scissors members 42 and 44 are rods 48 and 50, which extend across underneath the upper base platform 36 to connect to the corresponding scissors members 42 and 44 at the opposite end of the rack, as shown in FIG. 1. The second set of scissors is identical to the first set. The upper end of scissors 42 and 44 are interconnected to the identical pair 42 and 44 on the opposite side of the rack by pin members 52 and 54. Stretched between pin members 52 and 54 is a resilient means, such as a spring 56, or an elastomeric member, thereby biasing the scissors device to the closed position, as shown in FIG. 1.

Figure 8:
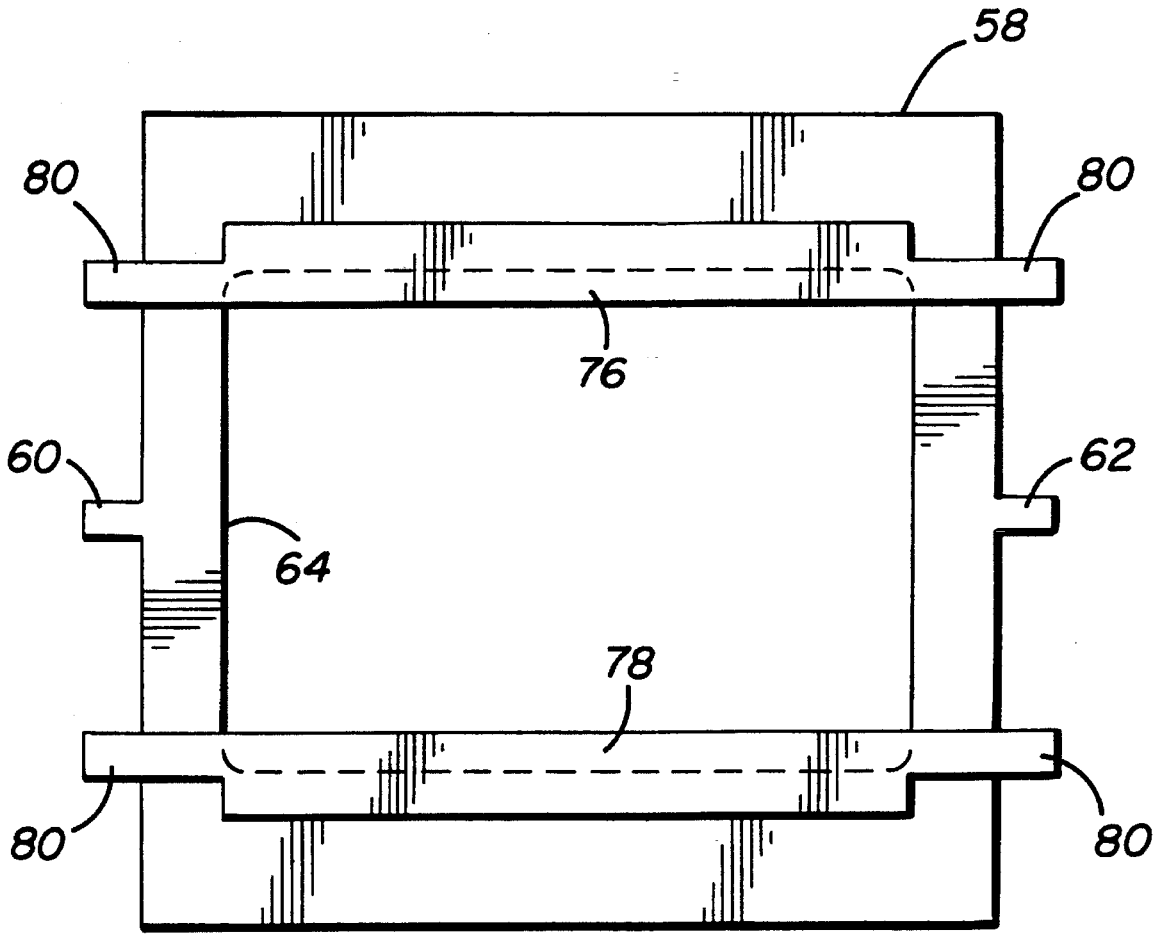
FIG. 8 is the lower member of the platform assembly and the slides.

The upper platform assembly 18 consists of three members affixed one to the other. A lower member 58 is shown in FIG. 8. The lower member 58 is rectangular in shape and has extending outwardly therefrom two bosses 60 and 62, which are adapted to ride in slots 38 on each of the two ends, 14 and 16. A rectangular opening 64 is centered on the lower piece 58. Opening 64 is sufficiently large to let a pipette tip flat (to be described) pass therethrough in a flat orientation.

Figure 9:
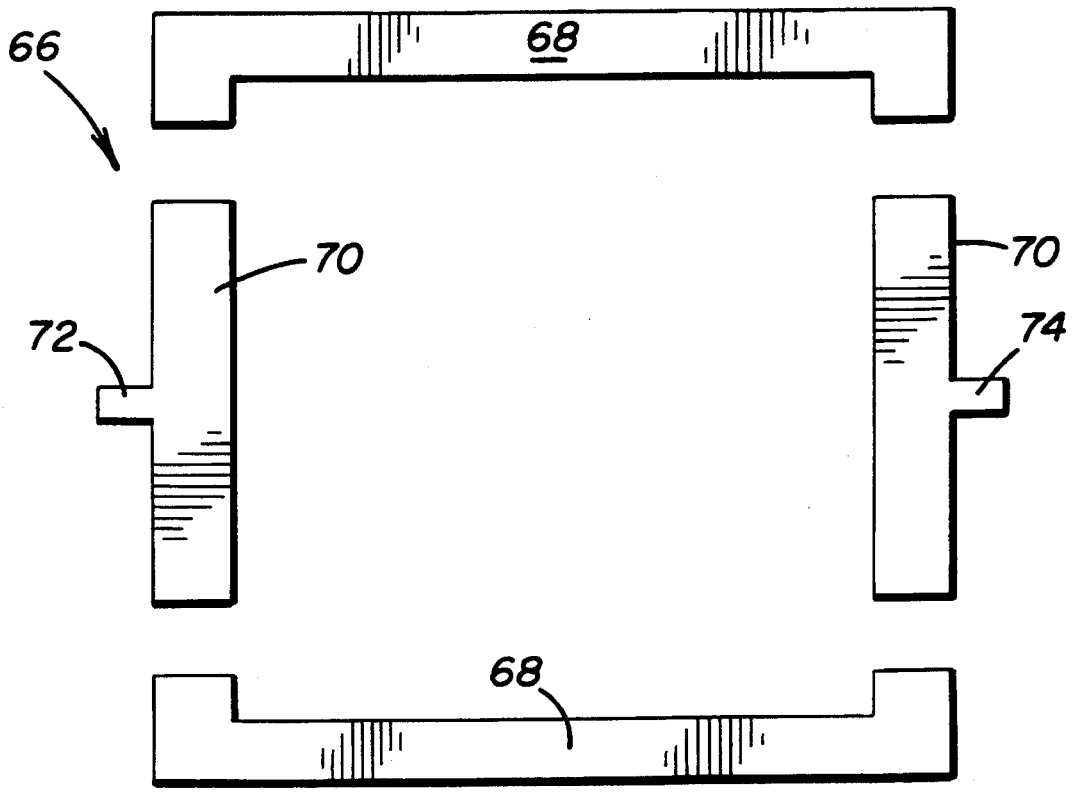
FIG. 9 shows the spacers that form the middle of the platform assembly.

The center portion of the upper platform consists of a spacer assembly 66, shown in FIG. 9. Spacer assembly 66 itself consists of two longitudinal members 68 which are identical in structure and two spacer members 70, also identical in structure. These pieces of the center assembly 66 are placed atop of lower platform member 58 so that the two elongated pieces 68 are adjacent the corresponding sides of the lower platform 58, with the intervening side pieces 70 positioned adjacent the bosses 60 and 62 so that corresponding bosses 72 and 74 register with the bosses 60 and 62. The openings formed by the positioning of the center piece 66 are purposely left open so that the slides 76 and 78, shown in FIG. 8, may move laterally toward and away from the opening 64.

With the slides 76 and 78 in their closed position, a pipette tip flat (to be described) will not pass through the opening 64. In their open position, that is, drawn laterally away from the opening 64, the pipette tip flat will pass through the opening 64. Fitted on either end of slides 76 and 78 are bosses 80, which in fact are cam followers for the cam slots 20 and 22.

Figure 10:
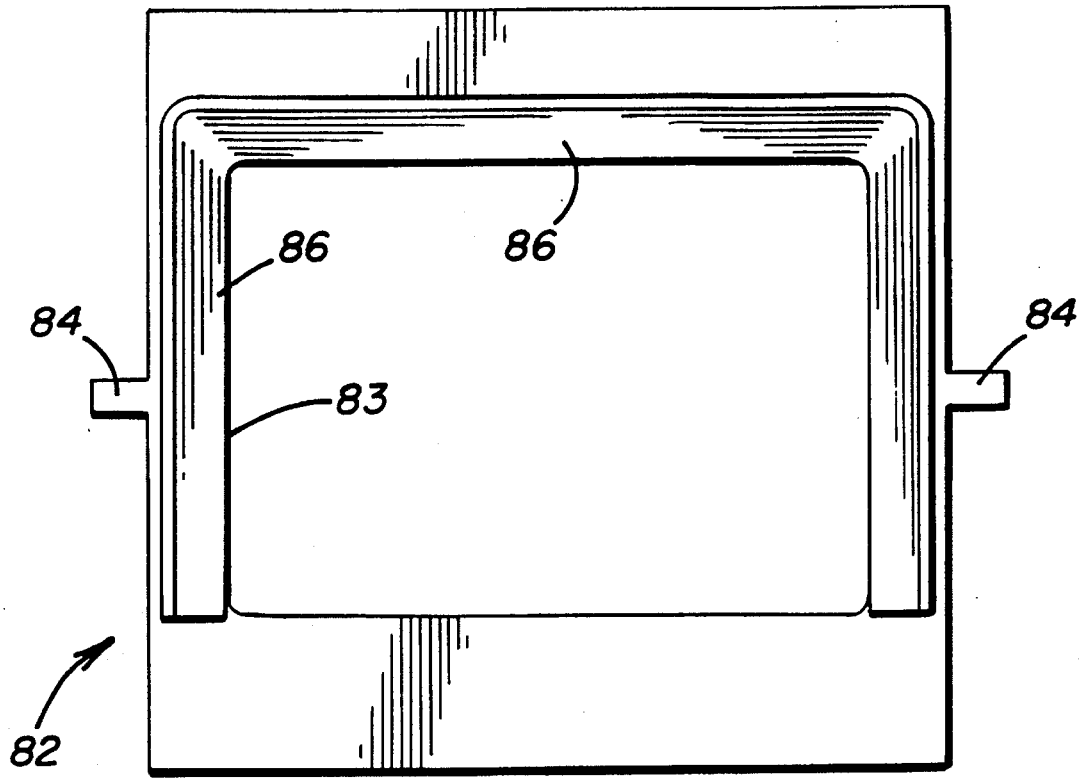
FIG. 10 is the upper member of the platform assembly.

The upper member of the platform 18 is a rectangular piece 82, as shown in FIG. 10. The upper member 82 corresponds to the lower member 58, with the exception that the opening in the upper surface thereof may be slightly smaller, but is at least as large as the pipette tip flat that is passed therethrough. Again, bosses 84 are located on the sides of the top platform 82 so that they register with the previously described bosses 60, 62, 72 and 74 located respectively on the lower platform and the middle platform of the upper assembly. On the upper assembly 82 are stop members 86 which surround the opening 88 defined in the upper member 82. The stop members 86 on the upper surface of the upper top platform 82 serve to register a pipette tip flat 90 (see FIG. 4).

When assembled, the platform assembly 18 may be prevented from separating from the rest of the assembly by the closures in the slots 20, 22, and 28, as shown in FIG. 5. The platform assembly 18 is prevented from moving upwardly beyond that point, but is biased upwardly by the parallel motion action of the scissors 42 and 44.

Figure 4:
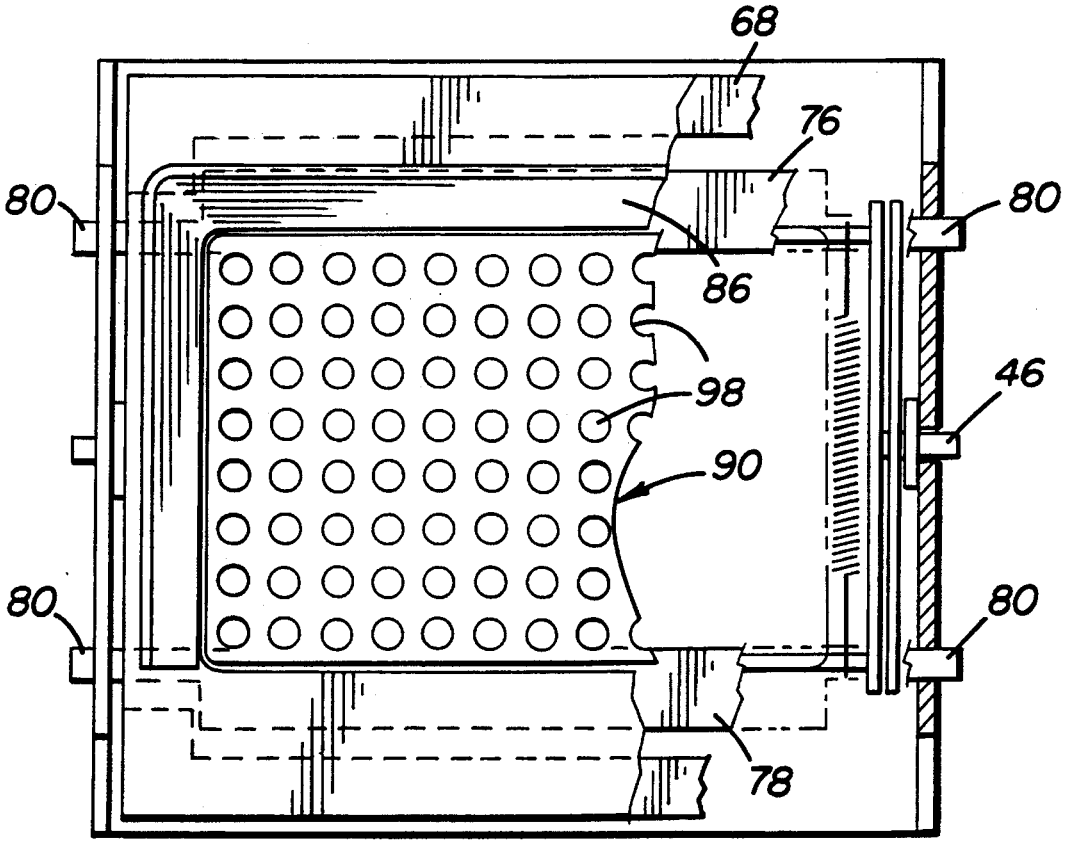
FIG. 4 is a top view of the pipette tip loading device shown in FIG. 1.

Referring to FIG. 4, an upper view of a pipette tip flat 90 is illustrated positioned in the tip loader 10. In the side view in FIG. 3, this same rack 90 is located in the rack with attendant pipette tips 92. A second flat 94 is shown for illustration purposes only, along with its plurality of pipette tips 96. The flats 90, best shown in FIG. 4, contain a plurality of holes 98 in which pipette tips, such as pipette tips 92 and 96, may be positioned. These holes are carefully registered with a corresponding set of holes in a pipette tip rack 100, which is shown in phantom in FIG. 1. Pipette tip rack 100, as noted above, has an equal number of holes in its upper surface.

In operation, a flat 90 or a plurality of flats 90, 94 (see FIG. 3) are placed in the opening in the upper platform 18. At this point, they are resting on the two slides 78 and 76 (see FIG. 8) and will not pass through the opening in the lower portion of the top platform. Further, the registration members 86 insure that the holes 98 in the flat 90 are registered with a rack 100. Rack 100 is similarly held in a predetermined position by bars 102. The top platform 18 is depressed manually so that the parallel motion arms 42 and 44 separate, as best illustrated in FIG. 2. As the cams 80 pass down the camming slots 20 and 22, they separate and withdraw the slides 76 and 78 so that the pipette tips 90 register with the holes in the pipette tip rack 100. As the structure reaches its lowest position, as shown in FIG. 2, the slides 78 and 76 fully open and the flat 90 is released to rest upon the pipette tip rack 100, which is shown in phantom in FIGS. 1 and 2.

At this point, the second flat 94, as can be seen in FIG. 2, is above the diverging portions of the camming slots 20 and 22, so that as the platform assembly 18 is urged upwardly by the resilient member 52, bringing together the scissors 42 and 44, the slides 76 and 78 are cammed inwardly by those slots 20 and 22 to pick up the next pipette tip flat 94 as the assembly expands into its position, shown in FIG. 1. At that point, the pipette tip rack 100 may be withdrawn from the device as the tip ends in the next flat 94 do not extend downwardly far enough to rest in the flat just positioned on the top of rack 100.

The technician may then take rack 100 off to a workspace to utilize the tips placed therein in the assembly.

Once the tips are exhausted in rack 100, the flat 90 can be placed in a salvage bin while the rack 100 is returned to the device 10 to have a second or another set of pipette tips and associated flat inserted therein.

The advantage of this assembly is that the pipette tip rack may be used over and over again, while the only thing returnable to the manufacturer are the flats 90 and, if desired, the used pipette tips 92 and 96. This saves the manufacturer in that the pipette tip racks need not be manufactured equal to the pipette tips, but rather a flat is manufactured containing the requisite number of pipette tips. The user is saved the chore of placing pipette tips 90 into the rack 100 by hand, which has been the practice in the past. Further, rather than sending back pipette tip racks, which some pipette tip users had been doing, the pipette tip racks may be recycled right in the laboratory.

This invention is limited only by the appended claims which follow.

It is claimed:

1. A loading device for placing a plurality of pipette tips positioned in a flat into an upstanding pipette tip rack, the loading device comprising:

a rectangular base assembly;

a pair of side plates affixed at opposite ends of the base assembly to extend upwardly therefrom;

a platform assembly positioned between said pair of side plates and movably associated with said pair of side plates so that said platform may move from a first position distal of said base to a second position proximate of said base;

parallel motion means for maintaining said platform assembly in a parallel relation with said base assembly while the platform assembly moves from said first position to said second position;

said platform assembly including release means for retaining a flat on said platform assembly while said platform assembly is distal of said base and for releasing said flat at a predetermined position while said platform moves toward said second position proximate said base.

2. The device of claim 1 wherein said platform is resiliently biased toward said first position.

3. The device of claim 1 where said platform while in said second position is spaced apart from said base a distance greater than the height of said pipette tip rack.

4. The device of claim 1 wherein said platform includes guide means for positioning said flat at a predetermined location in said platform.

5. The device of claim 1 wherein said platform, while said platform assembly is distal of said base, defines a rectangular opening smaller than the dimensions of said flat and where said rectangular opening is larger than the dimension of said flat while said platform assembly is in said second position.

6. The device of claim 1 wherein the base assembly includes guide means for positioning said pipette tip rack in a predetermined position.

7. The device of claim 1 wherein the parallel motion means comprises a first pair of bars each pivotally affixed at one end thereof to the base assembly along one end thereof, and slidably associated with said platform assembly along one end of the platform assembly, and a second pair of bars each pivotably affixed at one end thereof to the base assembly along the opposite end thereof, and slidably associated with said platform assembly along the opposite end of the platform assembly.

8. The device of claim 1 wherein each of the side plates defines a pair of camming slots separated a first distance proximate the upper ends of the side plate and extending downwardly in a parallel relation a predetermined distance, the camming slots then diverging for a second predetermined distance, the release means including slide members movably mounted on said platform in a parallel relation and separated one from another by a distance less than the width of said flat while said platform is in the up position; and cam followers affixed at each end of the slide members and riding in the camming slots whereby when said platform is mounted from its first upper position to its second lower position said slide members separate when said cam followers reach the point the cam slots diverge.

9. A pipette tip loading assembly comprising:

a pipette tip rack having an upper surface defining a plurality of holes in a regular pattern;

a flat, rectangular member defining a plurality of holes in the same regular arrangement as the upper surface of the pipette tip rack, each hole formed to receive a pipette tip;

a loading device consisting of a rectangular base assembly adapted to receive said tip rack in a predetermined location;

a pair of side plates affixed at opposite ends of the base assembly to extend upwardly therefrom;

a platform assembly movably associated with said pair of side plates so that said platform may move from a first position distal of said base to a second position proximate of said base;

parallel motion means for maintaining said platform assembly in a parallel relation with said base assembly while the platform moves from said first position to said second position;

said platform assembly including release means for retaining said flat on said platform assembly while said platform assembly is distal of said base and for releasing said flat at a predetermined position while said platform moves toward said second position proximate said base.

10. The assembly of claim 9 wherein said platform is resiliently biased toward said first position.

11. The assembly of claim 9 where said platform while in said second position is spaced apart from said base a distance greater than the height of said pipette tip rack.

12. The assembly of claim 9 wherein said platform includes guide means for positioning said flat at a predetermined location in said platform.

13. The assembly of claim 9 wherein said platform defines a rectangular opening smaller than the dimensions of said flat.

14. The assembly of claim 9 wherein the base assembly includes guide means for positioning said tip rack in a predetermined position.

15. The assembly of claim 9 wherein the parallel motion means comprises a first pair of bars each pivotally affixed at one end thereof to the base assembly along one end thereof, and slidably associated with said platform assembly along one end of the platform assembly, and a second pair of bars each pivotably affixed at one end thereof to the base assembly along the opposite end thereof, and slidably associated with said platform assembly along the opposite end of the platform assembly.

16. The assembly of claim 9 wherein each of the side plates defines a pair of camming slots separated a first distance proximate the upper ends of the side plate and extending downwardly in a parallel relation a predetermined distance, the camming slots then diverging for a second predetermined distance, the release means including slide members movably mounted on said platform in a parallel relation and separated one from another by a distance less than the width of said flat while said platform is in the up position; and cam followers affixed at each end of the slide members and riding in the camming slots whereby when said platform is moved from its first upper position to its second lower position said slide members separate when said cam followers reach the point the cam slots diverge.

17. A method of loading pipette tips comprising the steps of:

1) providing at least two flats, each flat having a upper and lower surface and each flat defining a plurality of holes therethrough in a regular pattern, and at least some of said holes having positioned within the hole a pipette tip extending through the flat, said at least two flats including an inferior flat and a superior flat, said superior flat resting on the pipette tips extending through the inferior flat, and with the pipette tips extending through the superior flat nesting with the pipette tips extending through the inferior flat;

2) providing a pipette tip rack having upstanding sides and an upper surface having a regular pattern of holes corresponding to the holes in the flats set forth in step 1;

3) providing a parallel motion loading device having a moveable platform assembly moveable from an upper position to a lower position, said platform assembly including release means operable in the upper position for supporting said inferior flat, and operable in the lower position for releasing and positioning said inferior flat and said pipette tips in said pipette tip rack;

4) positioning said pipette tip rack in said loading device;

5) positioning said inferior flat and said superior flat on said loading device;

6) operating said parallel motion loading device so that said inferior flat is lowered by said platform assembly for releasing and positioning said inferior flat on top of the pipette tip rack with the pipette tips extending through the holes in the upper surface of the pipette tip rack, and said superior rack is supported by said parallel motion loading device upon release of said inferior rack.

* * * * *